US009404236B2

(12) United States Patent
Toraason et al.

(10) Patent No.: US 9,404,236 B2
(45) Date of Patent: Aug. 2, 2016

(54) THUMB ASSEMBLY HAVING A STOP

(71) Applicant: Cascade Corporation, Portland, OR (US)

(72) Inventors: Mark William Toraason, Kirkland, WA (US); Erik Russell Bare, Bothell, WA (US)

(73) Assignee: Cascade Corporation, Fairview, OR (US)

( * ) Notice: Subject to any disclaimer, the term of this patent is extended or adjusted under 35 U.S.C. 154(b) by 0 days.

(21) Appl. No.: 14/510,586

(22) Filed: Oct. 9, 2014

(65) Prior Publication Data

US 2016/0102444 A1 Apr. 14, 2016

(51) Int. Cl.
*E02F 3/40* (2006.01)
*E02F 3/413* (2006.01)

(52) U.S. Cl.
CPC ..... *E02F 3/404* (2013.01); *E02F 3/4135* (2013.01)

(58) Field of Classification Search
CPC ..... E02F 3/404; E02F 3/413; E02F 3/4135; E02F 3/963
USPC ..... 37/404, 405, 406; 414/724
See application file for complete search history.

(56) References Cited

U.S. PATENT DOCUMENTS 4,519,739 A * 5/1985 Risch ..... E02F 3/404 29/428
5,082,389 A 1/1992 Balemi
5,111,602 A * 5/1992 Risch ..... E02F 3/404 37/406
5,472,308 A 12/1995 Somero
5,813,822 A 9/1998 Pisco
6,385,870 B1 5/2002 Webel et al.
6,990,758 B1 1/2006 Holmes et al.
7,241,101 B2 * 7/2007 Bauer ..... A01F 25/2027 414/726
7,617,619 B2 11/2009 Cox
7,753,641 B2 7/2010 Seljestad
8,615,907 B2 * 12/2013 Miller ..... E02F 3/404 172/615
8,695,239 B2 4/2014 Seda et al.
8,827,626 B2 9/2014 Seljestad
9,194,098 B2 * 11/2015 Shea ..... E02F 3/404
2005/0264018 A1 * 12/2005 Cummings ..... E02F 3/404 294/197
2007/0220782 A1 9/2007 McCoy
2010/0058622 A1 3/2010 Calvert et al.
2012/0328400 A1 12/2012 Seljestad
2013/0216347 A1 * 8/2013 Breuer ..... E02F 3/325 414/739
2014/0102243 A1 * 4/2014 Shea ..... E02F 3/404 74/527
2014/0215866 A1 * 8/2014 Seda ..... E02F 3/404 37/406

OTHER PUBLICATIONS

Brochure entitled Cat Thumbs 311-349 Hydraulic Excavators, Caterpillar, Inc., Jun. 2014, 8 pgs.

* cited by examiner

*Primary Examiner* — Gary Hartmann
(74) *Attorney, Agent, or Firm* — Chernoff, Vilhauer, McClung & Stenzel LLP

(57) ABSTRACT

Mechanical stops in the linkage of a hydraulic thumb for a materials handling machine protect the hydraulic thumb actuator from damage.

15 Claims, 6 Drawing Sheets

THUMB ASSEMBLY HAVING A STOP

CROSS-REFERENCE TO RELATED APPLICATIONS

Not applicable.

BACKGROUND OF THE INVENTION

The invention relates to material handling equipment such as excavators and backhoes and clamping and grappling equipment used with material handling equipment and, more particularly, to a thumb assembly for use with such equipment.

The use of a thumb on material handling machinery is well known. While a thumb may be used with other implements, such as a rake, a thumb is commonly used in conjunction with a bucket on an excavator to make the bucket more effective in picking up material. For example, at demolition sites a thumb in conjunction with a bucket is a particularly useful means of handling material, such as concrete, lumber or pipe, which would be too large or otherwise difficult to be picked up solely by the bucket.

A thumb typically comprises a thumb frame which is pivotally attached to the underside of an excavator's stick and a link extending between the thumb frame and the stick to secure the thumb frame in position. The thumb frame is commonly of modular construction comprising a thumb body which is arranged for pivotal connection to the underside of the machine's stick and a tooth bar which is attached to the thumb body. The tooth bar is commonly configured to suit a particular bucket with which it will be used and typically comprises a number of teeth arranged to intermesh with teeth arrayed on the lower edge of the bucket.

When not in use, the thumb frame is typically pivoted to a stored position somewhat parallel and adjacent to the underside of the excavator's stick. From this position, the thumb frame can be pivoted relative to the stick to a working position where material can be clamped between the thumb frame and the implement. A link between the stick and the thumb frame secures the thumb frame in the stored position and in one or more working positions. Manual thumbs include a rigid or manually telescoped link between an anchor secured to the underside of the stick and the thumb frame enabling the thumb frame to be secured in the stored position and one or more working positions where material may be grasped by curling the bucket toward the thumb frame projecting from the underside of the stick. Connecting the stick and the thumb frame with a linear hydraulic actuator enables pivoting of the thumb frame from the stored position to an infinite number of working positions enabling material to be grasped by pivoting the thumb frame as well as by curling the bucket. In addition, the thumb frame can be pivoted throughout at least a portion of the bucket's movement to continue grasping material as the bucket is uncurled toward the unloading position.

However, the hydraulic thumb actuator on the underside of the stick is exposed to damage as a result of overtravel of the thumb frame in the stored and extended positions. To minimize interference with the use of the excavator it is desirable that the thumb frame be stored close to the stick which places the thumb frame in close proximity to the thumb actuator. Movement of the bucket and/or contact between the thumb frame and the surroundings can cause damaging contact between the thumb frame and the thumb actuator. On the other hand, as the thumb frame is pivoted toward the bucket by extension of the thumb actuator the rod of the actuator approaches the underside of the stick and overtravel of the thumb frame, for example, as a result of contact with the surroundings, can cause damaging contact between the actuator's rod and the stick. One or more, mechanical stops may be attached to the underside of the stick to prevent contact between the thumb frame and the thumb actuator but the additional welding and weld preparation which may include removing parts attached the stick, and the need to precisely locate the stop on the stick complicates the installation of a stop to protect the thumb actuator. What is desired, therefore, is a hydraulic thumb incorporating a mechanical stop to protect the thumb actuator which does not require welding or precise positioning on the stick.

DETAILED DESCRIPTION OF PREFERRED EMBODIMENTS

Figure 1:
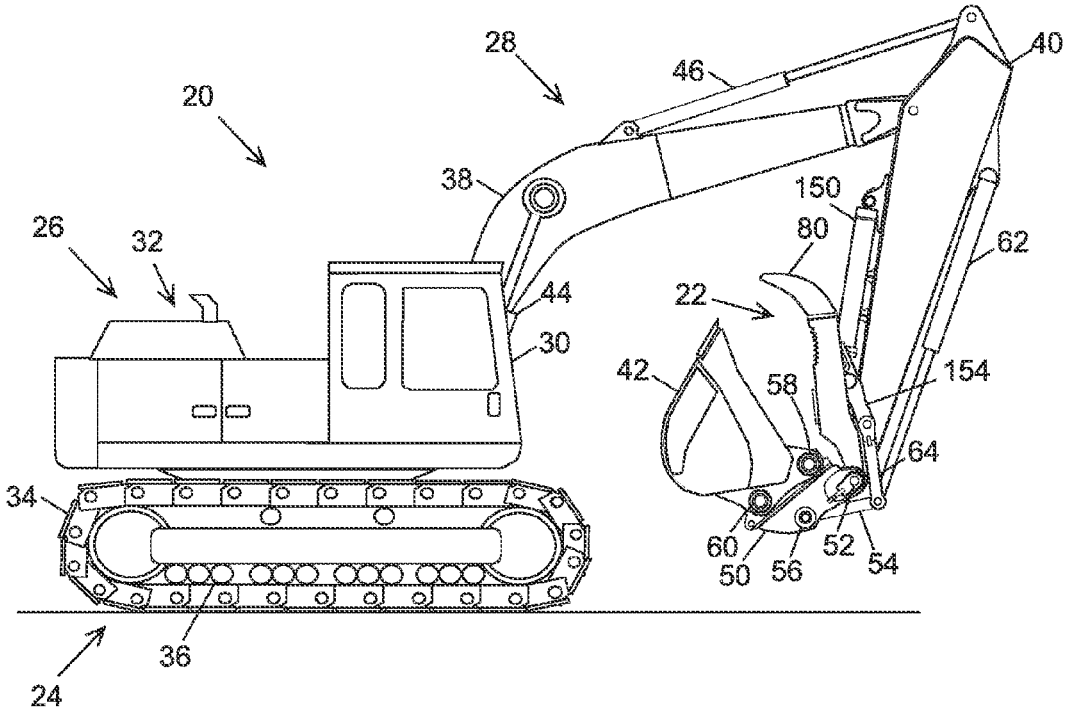
FIG. 1 is an elevation view of an exemplary materials handling machine equipped with a hydraulic thumb.
Figure 2:
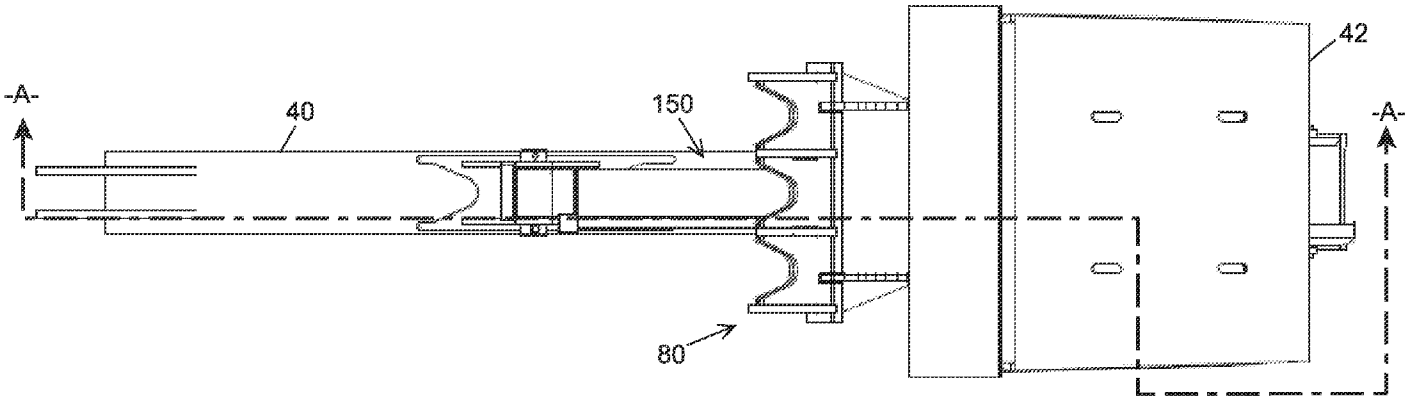
FIG. 2 is a plan view of a stick assembly for the materials handling machine of FIG. 1.

Referring in detail to the drawings where similar parts are identified by like reference numerals, and, more particularly to FIG. 1, an exemplary material handling machine, an excavator 20, includes a thumb assembly 22. The excavator 20 comprises generally an undercarriage 24 which includes a drive system for propelling the machine; a platform or house 26 rotatably supported by the undercarriage and an implement system 28. The house 26 commonly includes an operator station 30 and a power source 32 which may comprise a combustion power source, such as a diesel engine, or a non-combustion power source, such as an electric motor(s). The power source 32 commonly drives one or more hydraulic pumps which supply pressurized fluid to various actuators of the implement system, a rotator system for rotating the house relative to the undercarriage on a center pin and the drive system. The drive system commonly comprises hydraulic motors supplied with fluid through the center pin which power gearing and ground engaging elements, such as tracks 34 which are movable on track frames 36 supporting the undercarriage.

The implement system 28 typically comprises a boom 38, fixedly or movably attached to the house 26, a stick 40 pivotally attached proximate the end of the boom distal of its attachment to the house and an implement 42 pivotally attached to the end of the stick distal of its attachment to the boom. While the boom 38 may be immovably attached to the rotatable house 26, the boom is commonly pivotally attached and tiltable fore-and aft with respect to the house by one or more hydraulic boom actuators 44. However, the boom may also be mounted to be movable axially and/or to be pivoted horizontally with respect to a fore and aft axis of the house. The stick 40 is typically pivoted relative to the boom by a hydraulic stick actuator 46.

The implement 42 may be, by way of example and without limitation one of a large number of different sizes and types of buckets, such as the exemplary bucket, a ripper, a clamshell, a grapple, a rake, a compaction wheel, a vibratory compactor or a vibratory breaker. The implement is pivotally mounted at the end of the stick 40 distal of the stick's attachment to the boom 38. While the implement 42 may be attached directly to the stick, the excavator 20 may be equipped with a quick coupler 50, such as the coupler illustrated in U.S. Pat. No. 7,828,070, which is pivotally attached to the stick 40 by a first pin 52 and pivotally attached to a curl link 54 by a second pin 56. To attach an implement to the excavator 20, coupling elements of the quick coupler are arranged to engage and secure transverse front 58 and rear 60 pins affixed to the implement. Release of the pins enables detachment of the implement in preparation for attachment of a different implement.

The operator of the exemplary excavator 20 may control the operation of the implement system by operating a pair of joysticks located in the operator station 30. The exemplary implement system 28 can be extended or retracted by actuating the hydraulic boom actuator 44 to pivot the boom fore and aft relative to the house 26 and by actuating the stick actuator 46 to pivot the stick 40 relative to the boom. In addition, the implement, bucket 42, can be pivoted toward the stick 40 (curled) to fill the bucket or away from the stick (uncurled) to empty the bucket by extension and retraction of a hydraulic curl actuator 62 which is connected to the quick coupler 50 by the curl link 54 and the curl control link 64 which are pivotally connected to the curl actuator 62, the coupler 50, and the stick 40.

The exemplary excavator 20 is also equipped with a hydraulic thumb 22. Referring also to FIGS. 2, 3, 4, 5 and 6, the thumb 22 comprises, generally, a modular thumb frame 80 including a tooth bar 82 which is affixed to a thumb body 84. The exemplary tooth bar 82 comprises plural tooth plates 86, a web plate 88 which stabilizes the tooth plates horizontally and limits the penetration and retention of material between the tooth plates and a mounting plate 90 to which the tooth plates and the web plate are affixed. Typically, the teeth of the tooth bar are arranged to pass between pairs of teeth arrayed along the front edge of the bucket and the number and spacing of teeth on the tooth bar are typically determined by the number and spacing of teeth on the bucket that is most likely to be used with the thumb.

The tooth bar 82 is attached to the thumb body 84 usually by welding or bolting the mounting plate 90 to plural elongate side plates 92, 94 defining the sides of the thumb body and to a separator plate 96 which is secured between the side plates and aids in maintaining a spaced relationship of the side plates. Proximate the ends of the side plates 92, 94 distal of the tooth bar attachment, the side plates may also define apertures 98 arranged to receive a pin which pivotally joins the thumb frame and the stick. Preferably, the thumb frame 80 is pivotally coupled to the stick 40 by the same pin 52 that joins the coupler to the stick or, if connected directly to the stick, the same pin that joins the implement 42 to the stick. Connecting the thumb frame 80 to the stick with the pin 52 that pivotally couples the implement 42 to the stick ensures that the thumb frame and the implement, the bucket, pivot about the same axis and that corresponding points on the edges of side plates of the thumb and side plates of the bucket will follow the same arc as the bucket is curled or uncurled aiding in retaining material 43 clamped between the bucket and the thumb frame. Serrations 100 along the edges of the side plates 92, 94 nearest the bucket aid in retaining material grasped between the side plates and the bucket.

The separator plate 96 may also support plural anchor plates 102, 104 which are reinforced by gusset plates 106, 108, 110 connecting the anchor plates to each other and to the side plates. Apertures 112, 114 in the side plates 92, 94 aligned with apertures 116 defined by the anchor plates facilitate the installation of a pin 140 to connect a first end of plural thumb frame links 142 to the thumb frame. The second ends of the thumb frame links 142 are connected by a pin 144 to the rod 152 of the linear, hydraulic thumb actuator 150 and to a thumb control link 160 on each side of the stick 40. Second ends of the thumb control links 160 may be pivotally connected to the stick 40 by the curl control link pin 162 which pivotally connects the curl control link 64 to the stick. Extension and retraction of the thumb actuator 150 rotates the thumb control links 160 about the curl control link pin 162 moving the thumb links 142 to pivot the thumb frame 80 from a stored position proximate the underside 41 of the stick 40 to a range of working positions where material can be grasped between the thumb frame and the bucket 42.

It is desirable the thumb frame 80 be in close proximity to the underside 41 of the stick 40 when the thumb frame is in the stored position so that, when not in use, the thumb frame does not interfere with access to the implement 42. However, in the stored position the thumb frame 80 is also in close proximity to the thumb actuator 150 and a force applied to the thumb frame by, for examples, striking something in the surroundings with the thumb frame or the implement 42 or by something projecting from the implement, the bucket, when it is curled, can push the thumb frame into contact with and damage the shell 154 of the thumb actuator 150. Mechanical stops can be welded to the underside to the stick 40 to block movement of the thumb frame and protect the thumb actuator when the thumb frame is in the stored position but installation is difficult because the location of the stop must be closely controlled and may interfere with other elements secured to the stick.

On the other hand, as the thumb actuator 150 is extended to pivot the thumb frame 80 into proximity with the edge of the bucket 42, the distal end of the actuator's rod 152 moves away from the stick 40 and then toward the stick as the thumb control link 160 pivots about the curl control link pin 162. When fully extended the actuator's rod 152 is in close proximity to the underside of the stick. A force applied to the back of the thumb frame 80 can cause overtravel of the thumb mechanism resulting in damage the actuator's rod, the seals and bushing in the actuator's head 156 and/or the piston attached to the end of the rod.

Figure 3:
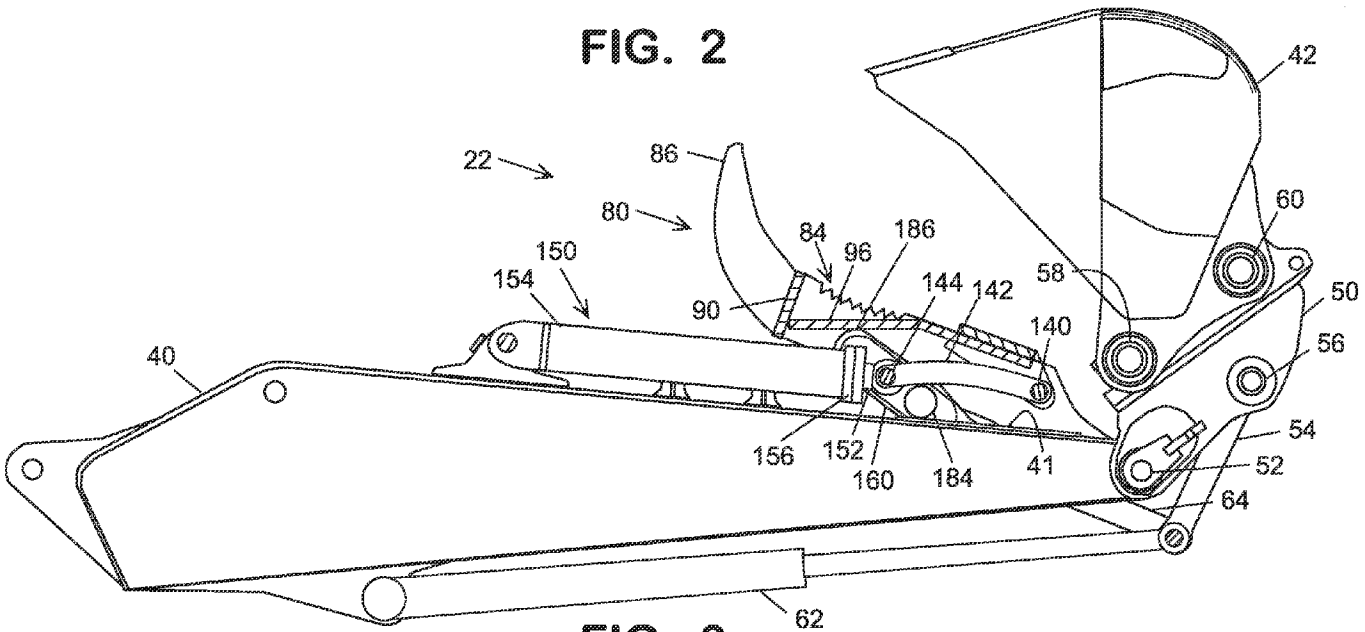
FIG. 3 is a side elevation view of the stick assembly of FIG. 2 with the hydraulic thumb in the stored position.
Figure 4:
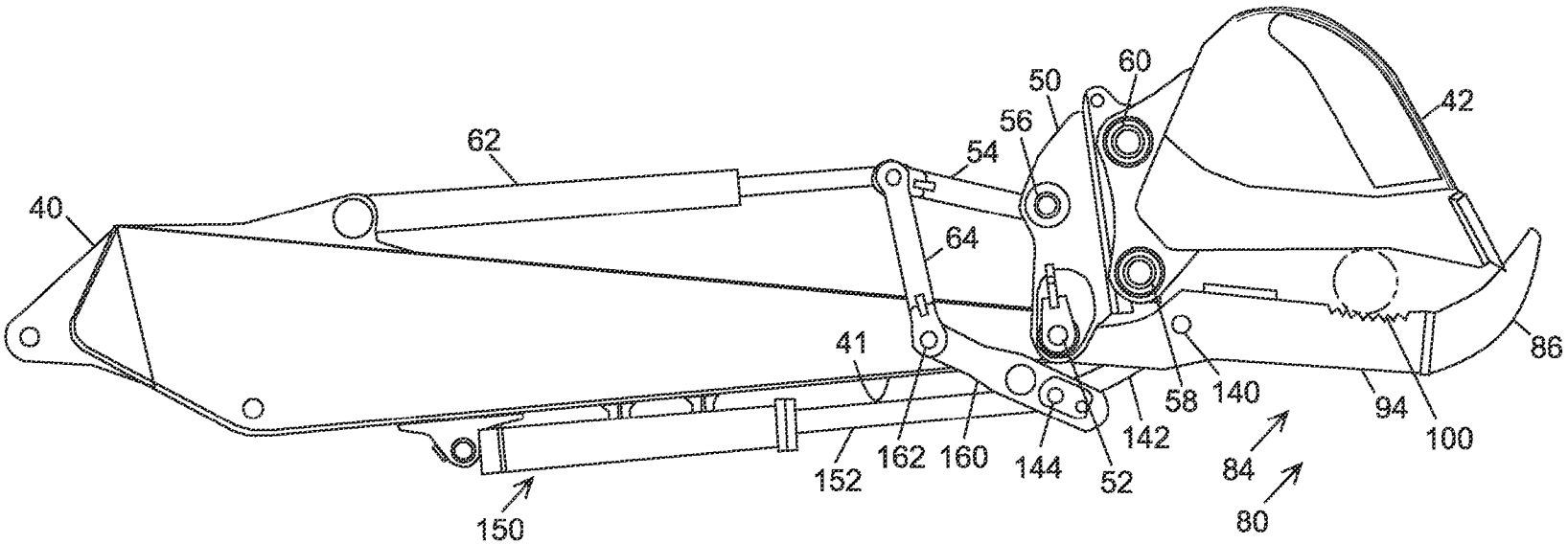
FIG. 4 is a side elevation view of the stick assembly of FIG. 2 with the hydraulic thumb in an extended position.
Figure 4A:
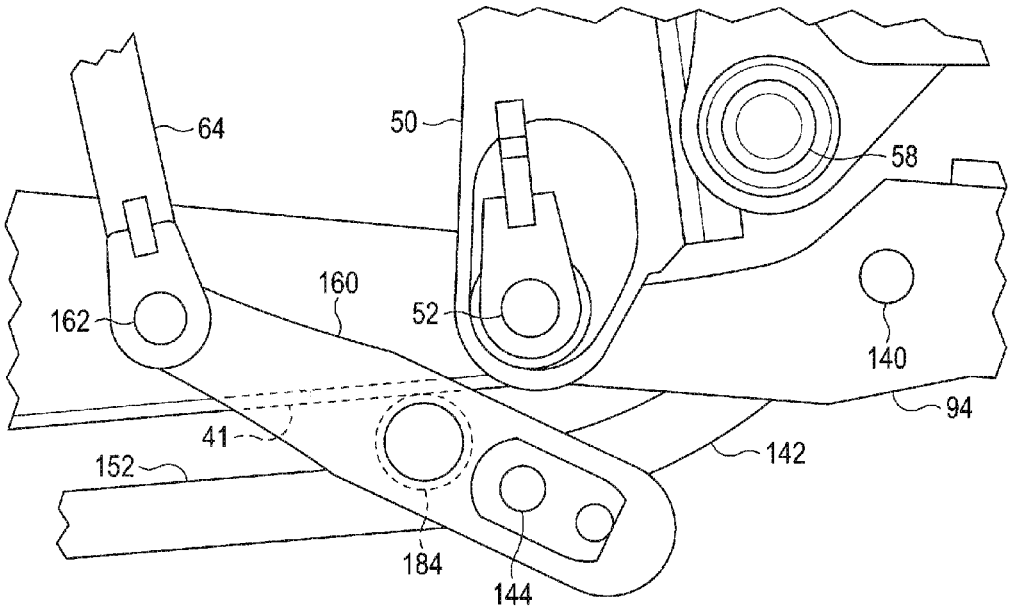
FIG. 4A is a side elevation view of a portion of the stick assembly of FIG. 2, with the hydraulic thumb in an extended position.
Figure 5:
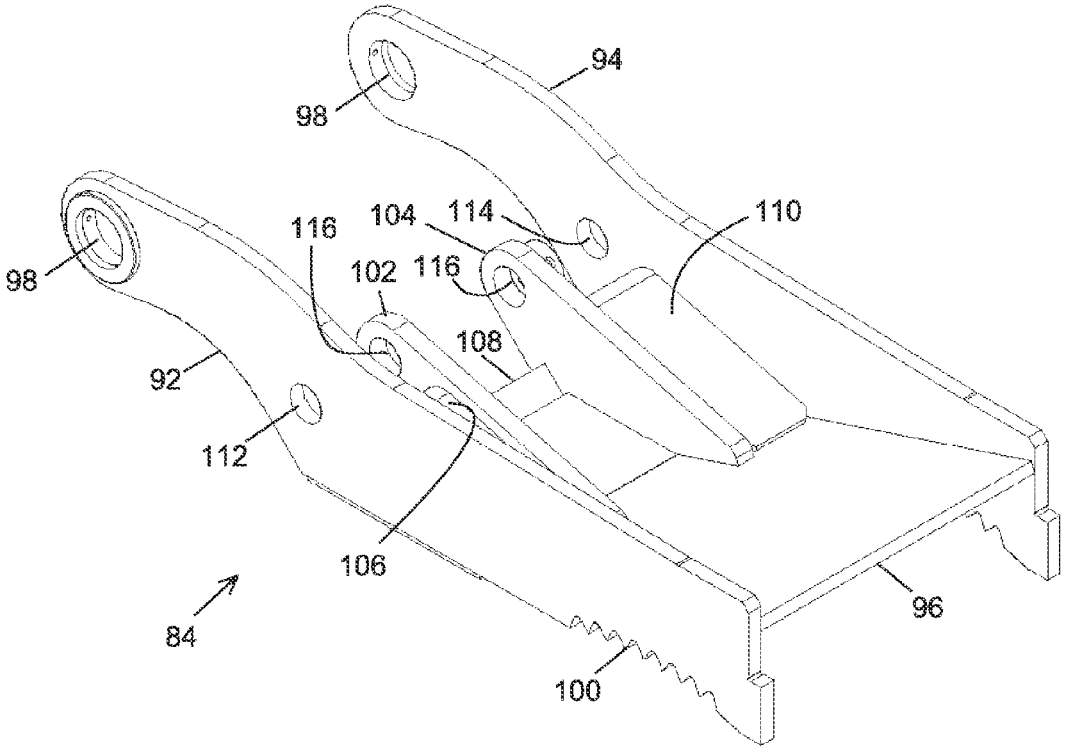
FIG. 5 is an orthogonal view of a thumb body.
Figure 6:
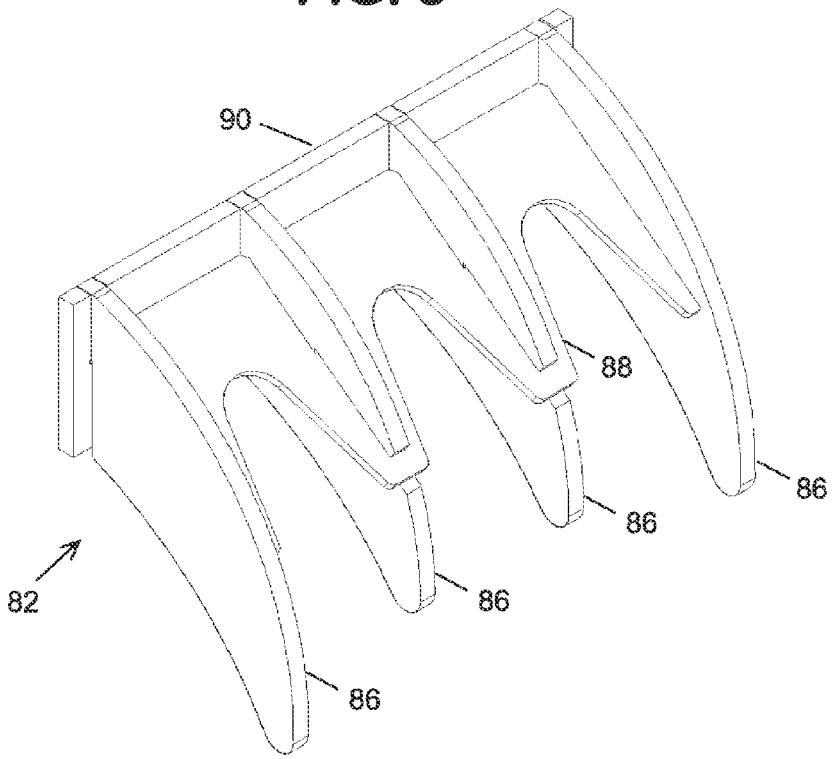
FIG. 6 is an orthogonal view of a tooth bar.
Figure 7:
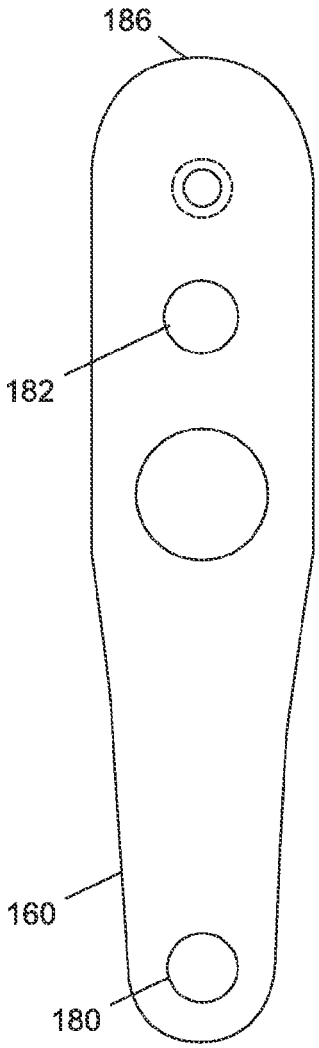
FIG. 7 is a first elevation view of a thumb control link.
Figure 8:
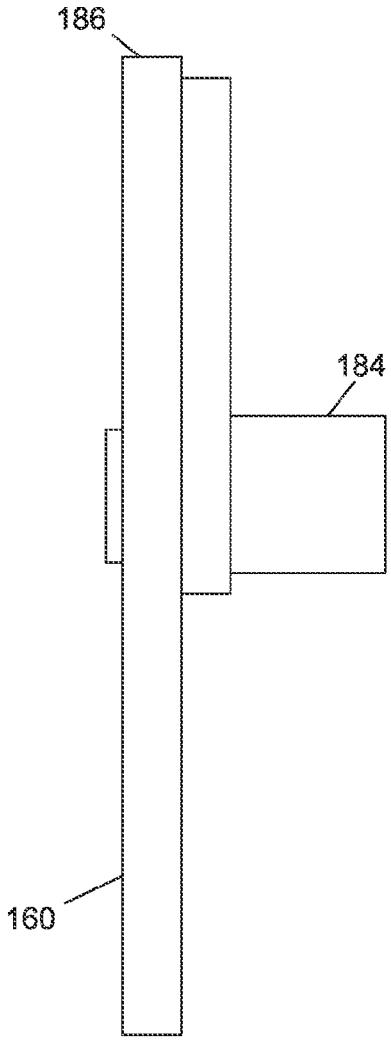
FIG. 8 is a second elevation view of the thumb control link of FIG. 7.
Figure 9:
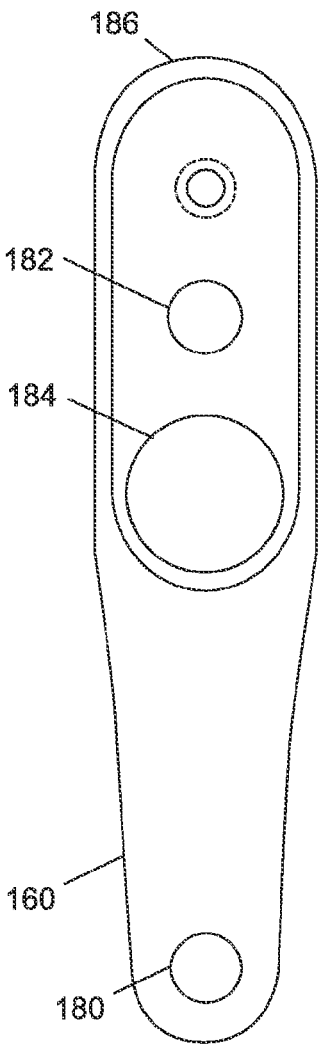
FIG. 9 is a third elevation view of the thumb control link of FIG. 7.

The inventor reasoned that integrating mechanical stops with the thumb linkage would enable mechanical stops at both limits of the thumb frame's movement; precise location of the stops could be achieved in a manufacturing environment; and a reduction weld preparation and welding on the stick during installation. Referring also to FIGS. 7, 8 and 9, the thumb control link 160 defines a first aperture 180 proximate one end for receiving the pin 162 on which the curl control link 64 pivots. Distal of the first aperture, the thumb control link 160 defines a second aperture 182 to receive the pin 144 that connects the rod 152 of the thumb actuator 150 and the thumb link 142. A primary stop 184 projecting from the thumb control link and in a direction substantially normal to longitudinal axis of the stick 40 may be affixed to the thumb control link 160 between the first 180 and second 182 apertures. As the thumb actuator 150 is retracted, as illustrated in FIG. 3, the thumb control link 162 rotates around the curl control link pin 162 until the primary stop 184 contacts the underside 41 of the stick 40 limiting further retraction of the thumb actuator and movement of the thumb frame toward the thumb actuator. When the rod 152 of the thumb actuator 150 is extended to pivot the thumb frame 80 toward the bucket 42, as illustrated in FIG. 4, the thumb control link 160 pivots toward the end of the stick until the primary stop 184 makes contact with the underside 41 of the stick 40 (as shown if FIG. 4A), thereby limiting movement of the thumb frame and preventing contact between the thumb actuator rod 152 and the stick.

While the primary mechanical stop 184 prevents overtravel of the mechanism at both limits of the thumb's movement, the inventor also realized that a force applied to the thumb frame, particularly at or near the tips of the teeth, could deflect the mechanism sufficiently so that the stored thumb frame might make contact with the thumb actuator 150. The thumb assembly 22 may include a secondary stop for the thumb frame 80 when in the stored position. The ends 186 of the thumb control links 160 distal of the aperture 180 for pivotal connection to the curl control link pin 162 extend beyond the primary stops 184 and are arranged to contact the separator plate 90 of the thumb body 84 in the event that the stored thumb frame is displaced toward the underside 41 of the stick 40. With one end of the thumb control link 160 secured by the curl control link pin 162 and with the primary stop 184 in contact with the underside of the stick 40, potentially damaging overtravel of the thumb frame is avoided.

Potential damage to the thumb actuator is avoided and installation complexity is reduced by mechanical primary and secondary thumb frame stops incorporated in the thumb actuation linkage.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

We claim:

1. A thumb for a material handling machine having a stick, the thumb comprising:

(a) a thumb frame pivotally connected to the stick;

(b) a thumb link having a first end portion pivotally attached to the thumb frame and a second end portion;

(c) a thumb actuator pivotally connected to the second end portion of the thumb link; and (d) a thumb control link including a first end portion pivotally attached to the stick, at a first location, a connection to at least one of the thumb link and the thumb actuator at a second location, and a stop arranged to contact a surface of the stick and limit pivoting of the thumb control link in response to retraction of the thumb actuator, the stop positioned along said thumb control link at a third location that is between the first location and the second location.

2. The thumb of claim 1 wherein the thumb control link further comprises a second end portion distal of the first end portion and the stop and arranged for contact by the thumb frame when the thumb actuator is retracted.

3. The thumb of claim 2 wherein the thumb frame comprises:

(a) a first side plate engageable with a first side of the stick and defining an aperture for a pivot pin;

(b) a second side plate spaced apart from the first side plate for engagement with a second side of the stick and defining an aperture for the pivot pin; and (c) a separator plate separating and affixed to the first side plate and the second side plate and arranged for contact with the second end portion of the thumb control link when the thumb actuator is retracted and the stop is in contact with the surface of the stick.

4. The thumb of claim 1 wherein the thumb frame and an implement are pivotally connected to the stick at a common connection.

5. The thumb of claim 4 wherein the thumb control link further comprises a second end portion distal of the first end portion and the stop and arranged for contact by the thumb frame when the thumb actuator is retracted.

6. The thumb of claim 5 wherein the thumb frame comprises:

(a) a first side plate engageable with a first side of the stick and defining an aperture for a pivot pin;

(b) a second side plate spaced apart from the first side plate for engagement with a second side of the stick and defining an aperture for the pivot pin; and (c) a separator plate separating and affixed to the first side plate and the second side plate and arranged for contact with the second end portion of the thumb control link when the thumb actuator is retracted.

7. A thumb for a material handling machine having a stick, the thumb comprising:

(a) a thumb frame pivotally connected to the stick;

(b) a thumb link having a first end pivotally attached to the thumb frame and a second end;

(c) a thumb actuator pivotally connected to the second end of the thumb link; and (d) a thumb control link including a first end pivotally attached to the stick, a connection to the thumb link and the thumb actuator, and a stop arranged to contact a surface of the stick and limit pivoting of the thumb control link in response to extension of the thumb actuator the stop positioned along said thumb control link at a location that is between the first end and the connection to the thumb link.

8. The thumb of claim 7 wherein the thumb frame and an implement are pivotally connected to the stick at a common connection.

9. A thumb for a material handling machine having a stick, the thumb comprising:

(a) a thumb frame pivotally connected to the stick;

(b) a thumb link having a first end pivotally attached to the thumb frame and a second end (c) a thumb actuator pivotally connected to the second end of the thumb link; and (d) a thumb control link including a first end portion pivotally attached to the stick, a connection to the thumb link and the thumb actuator, and a stop arranged to contact a surface of the stick and limit pivoting of the thumb control link in response to extension and retraction of the thumb actuator.

10. The thumb of claim 9 wherein the thumb control link further comprises a second end portion distal of the first end portion and the stop and arranged for contact with the thumb frame when the thumb actuator is retracted.

11. The thumb of claim 10 wherein the thumb frame comprises:

(a) a first side plate engageable with a first side of the stick and defining an aperture for a pivot pin;

(b) a second side plate spaced apart from the first side plate for engagement with a second side of the stick and defining an aperture for the pivot pin; and (c) a separator plate separating and affixed to the first side plate and the second side plate and arranged for contact with the second end portion of the thumb control link when the thumb actuator is retracted and the stop is in contact with the surface of the stick.

12. The thumb of claim 9 wherein the thumb frame and an implement are pivotally connected to the stick at a common connection.

13. The thumb of claim 12 wherein the thumb control link further comprises a second end portion distal of the first end portion and the stop and arranged for contact with the thumb frame when the thumb actuator is retracted.

14. The thumb of claim 13 wherein the thumb frame comprises:

(a) a first side plate engageable with a first side of the stick and defining an aperture for a pivot pin;

(b) a second side plate spaced apart from the first side plate for engagement with a second side of the stick and defining an aperture for the pivot pin; and (c) a separator plate separating and affixed to the first side plate and the second side plate and arranged for contact with the second end portion of the thumb control link when the thumb actuator is retracted.

15. The thumb of claim 14 further comprising a tooth bar including plural tooth plates and a web plate affixed to a mounting plate attachable to the first side plate and the second side plate.

* * * * *